US005089367A

United States Patent [19]

Murasawa et al.

[11] Patent Number: 5,089,367

[45] Date of Patent: Feb. 18, 1992

[54] ELECTROPHOTOGRAPHIC PHOTORECEPTOR CONTAINING TITANIUM DIOXIDE

[75] Inventors: Sadao Murasawa, Itami; Yoshio Hirobe; Hitoshi Ando, both of Moriyama, all of Japan

[73] Assignee: Ishihara Sangyo Kaisha, Ltd., Osaka, Japan

[21] Appl. No.: 471,798

[22] Filed: Jan. 29, 1990

[30] Foreign Application Priority Data

Feb. 2, 1989 [JP] Japan ..... 1-24584

[51] Int. Cl.[5] ..... G03G 5/08

[52] U.S. Cl. ..... 430/84; 430/95

[58] Field of Search ..... 430/84, 95

[56] References Cited

U.S. PATENT DOCUMENTS 4,386,146 5/1983 Kishino et al. ..... 430/95
4,820,620 4/1989 Carolla ..... 430/84

FOREIGN PATENT DOCUMENTS 58-40177 9/1983 Japan .
58-40178 9/1983 Japan .
63-18743 4/1988 Japan .
63-35977 7/1988 Japan .

*Primary Examiner*—John Goodrow
*Attorney, Agent, or Firm*—Cushman, Darby & Cushman

[57] ABSTRACT

Disclosed is an electrophotographic photoreceptor which is superior in sensitivity to light of longer wavelength region with good stability of the sensitivity and is suitable for formation of high quality color image by scanning exposure with laser beam. This photoreceptor comprises an electroconductive support and, provided thereon, a photosensitive layer containing a titanium dioxide sensitive to light of longer wavelengths which is obtained by treating the surface of titanium dioxide particles with a mineral acid and then supporting on the surface of the particles a cyanine dye sensitizer and a hydrophobic organic compound. The mineral acid is preferably hydrofluoric acid and the hydrophobic organic compound is preferably aromatic or aliphatic organic acid and acid anhydride thereof.

8 Claims, No Drawings

ELECTROPHOTOGRAPHIC PHOTORECEPTOR CONTAINING TITANIUM DIOXIDE

BACKGROUND OF THE INVENTION

The present invention relates to an electrophotographic photoreceptor which comprises an electroconductive support and, provided thereon, a photosensitive layer containing titanium dioxide having high sensitivity in longer wavelength region.

In general, electrophotographic photoreceptor comprises an electroconductive support on which is formed a photosensitive layer comprising a dispersion of a photoconductive material and, if necessary, a sensitizer in a binder resin. For formation of images, there has been well known so-called CPC method which comprises uniformly charging the photosensitive layer, imagewise exposing the charged surface to form an electrostatic latent image and then developing the latent image with developer to directly form a toner image on the photoreceptor. As the photoconductive material, zinc oxide has been most commonly used.

Recently, formation of so-called pictorial images by electrophotographic copying method has been more and more desired. Thus, with increase in demand for making high-quality images, it has been conducted to use a high-performance photoconductive material for photosensitive layer, to carry out various signal processings by changing original image to electrical signal by optoelectric transducing means or to apply so-called digital color image recording method according to which laser beam is modulated based on the above signal-processed information and scanning exposure is carried out by this laser beam.

Noticing the fact that as a photoconductive material of electrophotographic photoreceptor, titanium dioxide is superior to zinc oxide in tone reproduction of image, whiteness and hiding power, the inventors have conducted research to electrophotographically produce color image excellent in tone reproduction, graininess and resolving power by forming electrostatic latent image using said titanium dioxide photoreceptor and then developing the latent image with a developer containing toner particles, especially a liquid developer excellent in image graininess. As a result, it has been found that quality of the resulting color image is markedly improved, but there still remain some problems to be solved.

Cyanine dye sensitizers used for enhancing sensitivity in the region from visible long wavelength to near infrared wavelength are not necessarily sufficient in adsorbability to titanium dioxide particles and these sensitizers are apt to be much damaged in stability when they are used for sensitization to the longer wavelength region and thus they cannot impart stably the desired spectral sensitivity for a long time. Especially when semiconductor laser is employed as a light source, scanning exposure with laser beam is conducted, being different from the conventional whole surface exposure with visible light, it is important that change in unexposed portion is sufficiently retained for the period of from beginning of exposure to termination of exposure. As a result of intensive research conducted by the inventors in an attempt to solve the above problems, it has been found that the above problems can be solved by a photoreceptor comprising titanium dioxide sensitive to longer wavelength light prepared by modifying the surface of titanium dioxide particles by previous treatment with a mineral acid and then allowing the surface of the particles to support a cyanine dye sensitizer and a hydrophobic organic compound. Thus, the present invention has been accomplished.

SUMMARY OF THE INVENTION

The present invention provides an electrophotographic photoreceptor which comprises an electroconductive support and, provided thereon, a photosensitive layer which contains titanium dioxide sensitive to longer wavelength light obtained by treating the surface of titanium dioxide particles with a mineral acid and then supporting on the treated surface a cyanine dye sensitizer and a hydrophobic organic compound. The mineral acid is preferably hydrofluoric acid or hydrochloric acid.

The hydrophobic organic compound is preferably an aromatic organic acid or an acid anhydride thereof or an aliphatic organic acid or an acid anhydride thereof.

DESCRIPTION OF THE INVENTION

The photosensitive titanium dioxide used in the present invention can be prepared by various processes.

Titanium dioxide base particles used as raw material (hereinafter referred to as "base particles") can be prepared by forming hydrous titanium dioxide precipitate by hydrolyzing a titanium sulfate solution, a titanium tetrachloride solution or an organotitanium compound solution, if necessary, in the presence of seed crystal or by subjecting ammonium titanyl sulfate to heat decomposition. When these base particles are of rutile type crystal, usefulness of the present invention is further enhanced. Moreover, electrophotographic characteristics can be further improved by allowing metal components such as Zn, Li, Mg, Ba, Ca and Sr to be present during formation or growth of crystal of base particles. The base particles are in the form of a bunch of grapes or irregularly divided bunch of grapes and respective primary particles corresponding to respective grains of grapes are sintered with adjacent particles, but it is desired that this sintering is not so strong as extending to the whole surface of the primary particles and agglomeration of the primary particles is loose with high void content and large oil absorption. Accordingly, there can be also used titanium dioxide aggregates which comprise sintered aggregates of fine primary particles and have a rutile type crystal structure and an oil absorption of 35–65 obtained by hydrolyzing an acidic aqueous solution containing titanium dissolved therein by heating it in the presence of a rutile type seed crystal for hydrolysis to produce precipitates and calcining the precipitates at 700°–900° C. to sinter primary particles, as disclosed in U.S. patent application filed on Dec. 28, 1989 by inventor Sadao Murasawa entitled "Titanium dioxide aggregates, process for producing same and electrophotographic photosensitive material containing same" claiming Convention Priorities based on Japanese Patent Applications Nos. 63-332298 (filed on Dec. 28, 1988), 63-332299 (filed on Dec. 28, 1988) and 01-024583 (filed on Feb. 2, 1989), which is incorporated herein by reference.

As the mineral acids used for treatment of the base particles, mention may be made of sulfuric acid, nitric acid, hydrochloric acid, and hydrofluoric acid and hydrofluoric acid is preferred. The mineral acid treatment is usually carried out by suspending and immersing the base particles in an aqueous solution of the mineral acid of 0.005–20N in concentration. In case of using sulfuric acid, nitric acid or hydrochloric acid as mineral acid, the aqueous solution used is normally 0.1N or higher, preferably 0.1–10N is used. With increase in the concentration, lower treating temperature can be employed and treating time can be shortened. For example, when an aqueous solution of high concentration such as 6–10N is used, the treatment can be at about 60° C. for about 0.5–2 hours. When concentration of the aqueous solution is low, the desired effect can be obtained by raising the treating temperature or prolonging the treating time. For example, in case of the low concentration aqueous solution of 0.1–2N, the treatment may be carried out for about 1–3 hours at boiling point.

When the mineral acid is hydrofluoric acid, this is normally used as an aqueous solution and concentration thereof is usually 0.0005–20N, preferably 0.05–10N. In this treatment with hydrofluoric acid, further desired effect can be exhibited if a water-soluble fluorine compound such as ammonium fluoride, potassium fluoride, lithium fluoride, zinc fluoride or the like is present.

Solid product which has been subjected to immersing treatment with mineral acid is sufficiently washed so that substantialy no anion remains and then, if necessary, is subjected to dehydration and drying.

As cyanine dye sensitizer supported on base particles of titanium dioxide, there may be used various cyanine or merocyanine dye sensitizers having such chemical structure that containing therein, a group of atoms constitutes a heterocyclic ring including a nitrogen atom on at least one end of methine group. Preferred are at least one of those which have the following formula:

$$Z_1-(CH)_{n1}=\overset{\overset{\displaystyle Y}{|}}{C}-(CH)_{n2}=Z_2$$

In the above formula, $Z_1$ and $Z_2$ each represents a group of atoms necessary to form 5-membered pr 6- membered heterocyclic ring or a condensed ring containing 5-membered or 6-membered heterocyclic ring which may be substituted, and especially preferably, $Z_1$ and $Z_2$ are as follows:

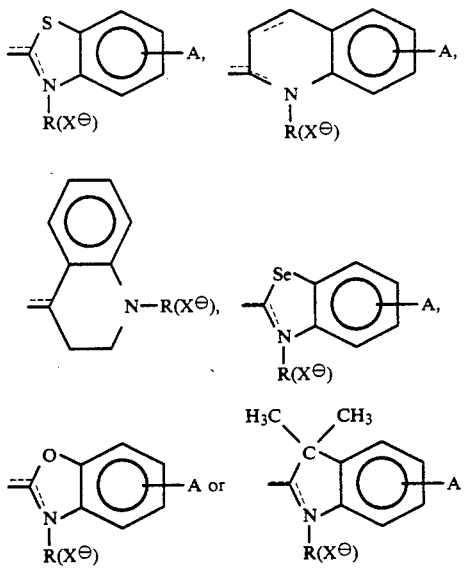

(wherein A represents a hydrogen atom, a halogen atom, a hydroxyl group, an alkyl group, an alkoxy group, an alkoxycarbonyl group, a carboxyl group which may be a salt or an anion, a phenyl group, or a group of atoms which form an aromatic 6-membered ring together with carbon atoms in 4,5 positions, 5,6 positions or 6,7 positions of the ring, R represents an alkyl group, a carboxyalkyl group which may be a salt or an anion, a sulfoalkyl group which may be a salt or an anion, or a hydroxyalkyl group, X⊖ is an anion of acid which can be present only when the nitrogen atom of ring is center of cation and R cannot be anion and when both of $Z_1$ and $Z_2$ are alkyl groups, at least one of A in $Z_1$ and A in $Z_2$ is a carboxyl group which may be a salt or an anion); Y represents a hydrogen atom, a halogen atom or an alkyl group; and $n_1$, $n_2$ are 0 or an integer of 1–3.

In the above mentions, the carboxyalkyl group which may be salt or an anion means —Alk—COOK, —Alk—COO⊖ and —Alk—COOH (—Alk— is an alkylene group and K is a cation which can produce a salt) and similarly, the —Alk—$SO_3K$, —Alk—$SO_3$ and —Alk—$SO_3H$. The anion of acid includes, for example, halogens such as chlorine, bromine and iodine and anions such as ethylsulfonate and p-toluenesulfonate. The nitrogen-containing heterocyclic rings of $Z_1$ and $Z_2$ may be symmetric or non-symmetric.

Amount of the cyanine dye sensitizer used is normally 0.001–0 1% by weight, preferably 0.003–0.05% by weight of base particles. The sensitizer may be contained in the photosensitive layer by various known methods. For example, the sensitizer may be adsorbed and allowed to adhere to base particles by dipping them in a solution of the dye or the sensitizer may be added to a binder resin or a coating material used for forming the photosensitive layer.

In addition to the above cyanine dye sensitizer, if necessary, various sensitizing dyes such as xanthene dyes, phthalein dyes, triphenylmethane dyes, oxazine dyes, thiazine dyes and anthraquinone dyes may be used in combination with the cyanine dye.

As the hydrophobic organic compounds there may be used various compounds and examples thereof are various aromatic organic acids, esters thereof, acid anhydrides thereof and metal salts thereof such as phthalic acid, pyromellitic acid, benzoic acid, naphthalic acid, naphthoic acid, phthalic anhydride, nitrophthalic anhydride, dinitrophthalic anhydride and pyromellitic anhydride; various aliphatic organic acids, esters thereof, acid anhydrides thereof and metal salts thereof such as maleic acid, succinic acid, itaconic acid, capric acid, lauric acid, stearic acid, tristearin, oleic acid, rhodinic acid, octylic acid, maleic anhydride, succinic anhydride, and itaconic anhydride; and various alicyclic organic acids, esters thereof, acid anhydrides thereof and metal salts thereof such as naphthenic acid and zinc naphthenate.

Amount of this hydrophobic organic compound is normally 0.001–4% by weight, preferably 0.01–1% by weight of base particles If amount of the compound is less than this range, stability with time and dark decay (charge maintenance in the dark) of photoreceptor and effect on sensitizer cannot be sufficiently exhibited. If the amount is more than the range, chargeability and photosensitivity much decrease and image of desired quality cannot be formed. Addition of the hydrophobic organic compound can be carried out by various methods. For example, the compound may be added to binder resin or coating material for forming photosensitive layer. Besides, base particles to which cyanine dye sensitizer has been previously adsorbed are immersed in a solution of hydrophobic compound or base particles are immersed in a solution of cyanine dye sensitizer and hydrophobic organic compound to adsorb them simultaneously. Alternatively, the base particles are previously immersed in a solution of hydrophobic organic compound to adsorb the compound to the particles and thereafter cyanine dye sensitizer is adsorbed to the particles. In these ways, the cyanine dye sensitizer and the hydrophobic organic compound can be supported on the base particles. If necessary, these treatments may be carried out with heating to obtain more preferred effect.

In the present invention, in addition to the above-mentioned sensitizing dye and hydrophobic organic compound, the electrophotographic photoreceptor may contain the known various property improvers such as those for charge characteristics, moisture resistance and for prevention of pre-exposure fatigue.

As binder resins used for forming a photosensitive layer, mention may be made of, for example, acrylic resins, alkyd resins, polyester resins, vinyl resins, silicone resins, amino resins, and polyurethane resins. These may be used singly or in combination. Proportion of the binder resin in the composition which constitutes photosensitive layer is about 15–55% by weight based on total amount of photoconductive material and resin.

The photoreceptor of the present invention comprises an electroconductive support and a photosensitive layer provided thereon. Various materials can be used as the support and examples thereof are paper and plastic films applied with electroconductivity by coating thereon or impregnating or filling therein various conductivity imparting agents (for example, electroconductive polymers, aluminum, palladium, indium oxide, and tin oxide and titanium dioxide particles covered or doped with tin oxide or antimony oxide) and metal sheets. Thickness of coating of the composition for photosensitive layer on the support can be varied in a wide range, but is preferably such that the thickness of photosensitive layer after dried is about 10–25 μm.

The photoreceptor of the present invention having a photosensitive layer containing the titanium dioxide which is sensitive to light of longer wavelengths has excellent sensitivity to light of 700–1000 nm such as semiconductor laser beam and besides has sufficient sensitivity to light of 633 nm such as He-Ne laser beam.

The photosensitive titanium dioxide used in photosensitive layer of photoreceptor of the present invention can be used for forming a photosensitive layer (photoconductive layer) of single-layer type electrophotographic photoreceptor and besides, it can be used for forming a carrier generation layer of double-layer type electrophotographic photoreceptor having a carrier generation layer and a carrier transport layer and furthermore it can be used as photoconductive particles in electrophoretic image formation.

The present invention is further explained by the following examples and comparative examples.

EXAMPLE 1

An aqueous solution containing 200 g/1 of titanium tetrachloride in terms of $TiO_2$ was hydrolyzed in the presence of hydrolyzing rutile seed crystal (in such amount as containing 5 mol% of Ti based on Ti in the aqueous solution of titanium tetrachloride) at 75° C. for 2 hours to precipitate hydrous titanium oxide. This precipitate was filtrated and washed with water and to the resulting wet cake was added ZnO fine powder in an amount of 2% based on the weight of $TiO_2$. Then, this wet cake was dried and then calcined at 790° .C for 2 hours This calcined product was suspended in water to prepare an aqueous slurry (400 g/1) and this slurry was subjected to stationary classification to remove particles of about 5 μm or larger and hydrofluoric acid was added to the slurry so that hydrofluoric acid concentration in the slurry was 3% by weight and this slurry was gently stirred to carry out immersing treatment for 1 hour. After completion of the treatment, the slurry was filtrated and further sufficiently washed with water to remove anion. The resulting composition was dried at 300° C. to obtain base particles. Oil absorption of the particles was 49.

The resulting base particles (20 parts by weight) were immersed in an ethanolic solution of 2-[7-(1-(2-hydroxyethyl)-3,3-dimethyl-2-indolinidene)-1,3,5-heptatriene-1-yl]-1-(2-hydroxyethyl)-3,3-dimethyl-3H-indolinium perchlorate as a sensitizing dye for 1 hour. Then, the immersed particles were dried under reduced pressure to support the sensitizing dye on the base particles. Thereafter, the particles on which the sensitizing dye was supported were immersed in a 1 wt% solution of stearic acid as a hydrophobic organic compound in toluene at 100° C. for 1 hour and then, the immersed particles were dried under reduced pressure thereby to support the hydrophobic organic compound thereon to obtain photosensitive titanium dioxide. (Sample A).

EXAMPLE 2

Photosensitive titanium dioxide was obtained in the same manner as in Example 1 except that maleic anhydride was supported thereon in place of stearic acid. (Sample B).

EXAMPLE 3

Photosensitive titanium dioxide was obtained in the same manner as in Example 1 except that nitrophthalic anhydride was supported thereon in place of stearic acid. (Sample C).

EXAMPLE 4

Photosensitive titanium dioxide was obtained in the same manner as in Example 1 except that phthalic acid was supported thereon in place of stearic acid. (Sample D).

EXAMPLE 5

Photosensitive titanium dioxide was obtained in the same manner as in Example 1 except that mineral acid treatment was carried out using slurry containing 3% by weight of hydrochloric acid in place of hydrofluoric acid and phthalic anhydride was supported in place of stearic acid. (Sample E).

EXAMPLE 6

Photosensitive titanium dioxide was obtained in the same manner as in Example 1 except that tristearin was supported in place of stearic acid. (Sample F).

EXAMPLE 7

Photosensitive titanium dioxide was obtained in the same manner as in Example 1 except that phthalic anhydride was supported in place of stearic acid. (Sample G).

EXAMPLE 8

Titanium dioxide was obtained in the same manner as in Example 1 except that 1-(2-carboxyethyl)-4-[3-(3-ethylbenzothiazolidone-2-ylidene)-1-propene-1-yl]quinolium iodide was used in place of 2-[7-(1-(2-hydroxyethyl)-3,3-dimethyl-2-indolinidene)-1,3,5-heptatriene-1-yl]-1-(2-hydroxyethyl)-3,3-dimethyl-3H-indolinium perchlorate as a sensitizing dye and that phthalic anhydride was supported in place of stearic acid. (Sample H).

COMPARATIVE EXAMPLE 1

Photosensitive titanium dioxide was obtained in the same manner as in Example 1 except that the immersion treatment with hydrofluoric acid was not conducted. (Sample I).

COMPARATIVE EXAMPLE 2

Photosensitive titanium dioxide was obtained in the same manner as in Example 7 except that the immersion treatment with hydrofluoric acid was not conducted. (Sample J).

COMPARATIVE EXAMPLE 3

Photosensitive titanium dioxide was obtained in the same manner as in Example 7 except that the treatment with phthalic anhydride was not conducted. (Sample K).

COMPARATIVE EXAMPLE 4

Photosensitive titanium dioxide was obtained in the same manner as in Example 7 except that the immersion treatment with hydrofluoric acid was not conducted and the treatment with phthalic anhydride was also not conducted. (Sample L).

Photoreceptors were prepared in the following manner using Samples A–L obtained above and were evaluated on properties.

To 16 g of the sample were added 12.7 g of AROSET 5804XC (acrylic resin) and 14.4 ml of xylene, followed by gentle mixing by a paint shaker containing glass beads to obtain a paste.

This paste was coated by a doctor blade on a synthetic paper on which aluminum had been vapor deposited and was dried at 100° C. for 10 minutes to form a photoreceptor having a photosensitive layer of 15 μm thick. This was stored in the dark place for 24 hours to subject it to sufficient dark adaptation and then photosensitivity was measured.

Photosensitivity was measured in the following manner. That is, the photoreceptor was charged with 300V by scorotron charging method and then subjected to continuous exposure and time required to decay the potential to 60V was measured. The photosensitivity is expressed by this time required for decay of the potential to 60V. Exposure was carried out using tungsten light source (illuminance of the surface of photoreceptor: 1000 lux) and the exposure was carried out through a band-pass filter of wavelength 780 nm for the photoreceptors prepared using the samples of Examples 1–7 and Comparative Examples 1–4 and through a red filter for the photoreceptor prepared using the sample of Example 8.

Then, the photoreceptors prepared using Samples A–L were left to stand in the dark place at less than 65%RH at 20° C. for 10 days and variation of photosensitivity with time was examined.

The results are shown in Table 1.

TABLE 1

| | Sample | Photo-sensitivity (sec) | Photosensitivity after left to stand for 10 days (sec) |
|---|---|---|---|
| Example 1 | A | 2.20 | 2.20 |
| Example 2 | B | 2.77 | 2.78 |
| Example 3 | C | 1.88 | 1.90 |
| Example 4 | D | 1.72 | 1.78 |
| Example 5 | E | 2.02 | 2.05 |
| Example 6 | F | 2.43 | 2.44 |
| Example 7 | G | 1.61 | 1.66 |
| Example 8 | H | 0.50 | 0.58 |
| Comparative Example 1 | I | 3.22 | 3.24 |
| Comparative Example 2 | J | 3.02 | 3.04 |
| Comparative Example 3 | K | 2.01 | 3.00 |
| Comparative Example 4 | L | 3.04 | 3.95 |

As is clear from the results of Table 1, the photoreceptors prepared using Samples A–H according to the present invention were superior to those prepared using Samples I–L in photosensitivity to light of longer wavelength region and in stability with time.

As explained above, the electrophotographic photoreceptors of the present invention are superior in light of longer wavelengths and besides in stability of photosensitivity with time and thus are suitable for scanning exposure with laser beam and industrially very useful for stable production of color images of high quality.

What is claimed is:

1. An electrophotographic photoreceptor which comprises an electroconductive support and, provided thereon, a photosensitive layer containing a titanium dioxide sensitive to light of longer wavelengths which is obtained by treating the surface of titanium dioxide particles with a mineral acid and then supporting on the surface of the particles a cyanine dye sensitizer and a hydrophobic organic compound selected from the group consisting of aromatic organic acids, esters thereof, acid anhydrides thereof and metal salts thereof; aliphatic organic acids having 8 or more carbon atoms, esters thereof, acid anhydrides thereof and metal salts thereof; and alicyclic organic acids, esters thereof, acid anhydrides thereof and metal salts thereof.

2. An electrophotographic photoreceptor according to claim 1, wherein the mineral acid is hydrofluoric acid.

3. An electrophotographic photoreceptor according to claim 1, wherein the mineral acid is hydrochloric acid.

4. An electrophotographic photoreceptor according to claim 1, wherein the hydrophobic organic compound is an aromatic organic acid or an acid anhydride thereof.

5. An electrophotographic photoreceptor according to claim 1, wherein the hydrophobic organic compound is an aliphatic organic acid or an acid anhydride thereof.

6. An electrophotographic photoreceptor according to claim 1, wherein the cyanine dye sensitizer is a cyanine or merocyanine dye sensitizer represented by the formula:

$$Z_1-(CH)_{n1}=\overset{\overset{\displaystyle Y}{|}}{C}-(CH)_{n2}=Z_2$$

wherein $Z_1$ and $Z_2$ each represents a group of atoms necessary to form a 5- or 6-membered heterocyclic ring which may be substituted or a condensed ring containing 5- or 6-membered ring which may be substituted, Y represents a hydrogen atom, a halogen atom or an alkyl group and $n_1$, $n_2$ are 0 or an integer of 1–3.

7. An electrophotographic photoreceptor according to claim 1, wherein the photosensitive layer comprises a single layer.

8. An electrophotographic photoreceptor according to claim 1, wherein the photosensitive layer comprising double layers of a carrier generation layer and a carrier transport layer and the titanium dioxide is contained in the carrier generation layer.

* * * * *